United States Patent [19]

Paoletti et al.

[11] 4,255,101

[45] Mar. 10, 1981

[54] DEVICE FOR THE CONTINUOUS SPINNING OF VISCOSE RAYON

[75] Inventors: Ugo Paoletti, Monza; Alessandro Volterra, Milan, both of Italy

[73] Assignee: SNIA Viscosa Societa' Nazionale Industria Applicazioni Viscosa S.p.A., Milan, Italy

[21] Appl. No.: 28,324

[22] Filed: Apr. 9, 1979

[30] Foreign Application Priority Data

Apr. 7, 1978 [IT] Italy ..... 22076 A/78
Sep. 29, 1978 [IT] Italy ..... 28324 A/78

[51] Int. Cl.[3] ..... B29D 7/02

[52] U.S. Cl. ..... 425/68; 264/196; 264/198; 425/71; 425/73

[58] Field of Search ..... 264/188, 196, 197, 198, 264/210.4, 210.7; 425/68, 71, 73

[56] References Cited

U.S. PATENT DOCUMENTS

| | | | |
|---|---|---|---|
| 2,303,696 | 12/1942 | Jordan | 264/188 |
| 2,427,993 | 9/1947 | McLellan | 264/210.7 |
| 2,532,465 | 12/1950 | Stanley | 264/210.4 |
| 2,714,052 | 7/1955 | Wizon et al. | 264/182 |
| 3,001,229 | 9/1961 | Drtina | 264/188 |

FOREIGN PATENT DOCUMENTS

| | | |
|---|---|---|
| 645171 | 10/1950 | United Kingdom . |
| 723779 | 2/1955 | United Kingdom . |
| 739178 | 10/1955 | United Kingdom . |

*Primary Examiner*—Jay H. Woo
*Attorney, Agent, or Firm*—Wenderoth, Lind & Ponack

[57] ABSTRACT

A device for the continuous spinning of viscose rayon includes a main or processing roller and a plurality of secondary or advancing rollers set askew with respect to the processing roller. The processing and advancing rollers are carried bracket-like by a support arm in which they are rotatively supported. The actuating structures are located in the vicinity of the supports of the respective rollers. The support arm is hollow and contains the roller supports and the actuating structures, and is located at the end of the unit at which the yarns leave the same after being processed. A plurality of spinning units are arranged in rows and the rows are born by a frame carrying all the necessary accessory devices. Means are provided for preventing the escape of fumes from the treatment liquors into the surrounding room.

21 Claims, 11 Drawing Figures

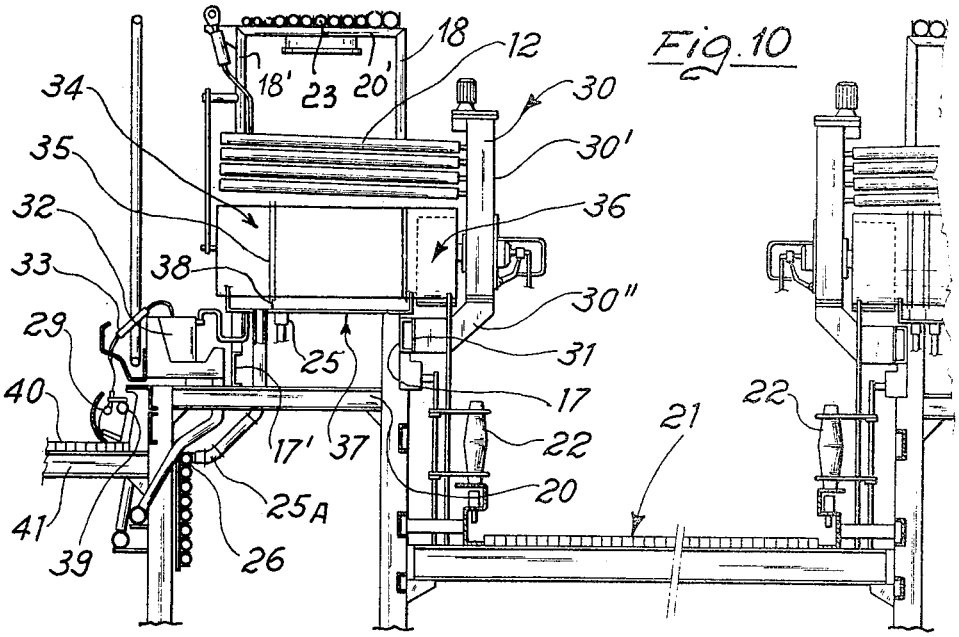
Fig. 10
Fig. 11
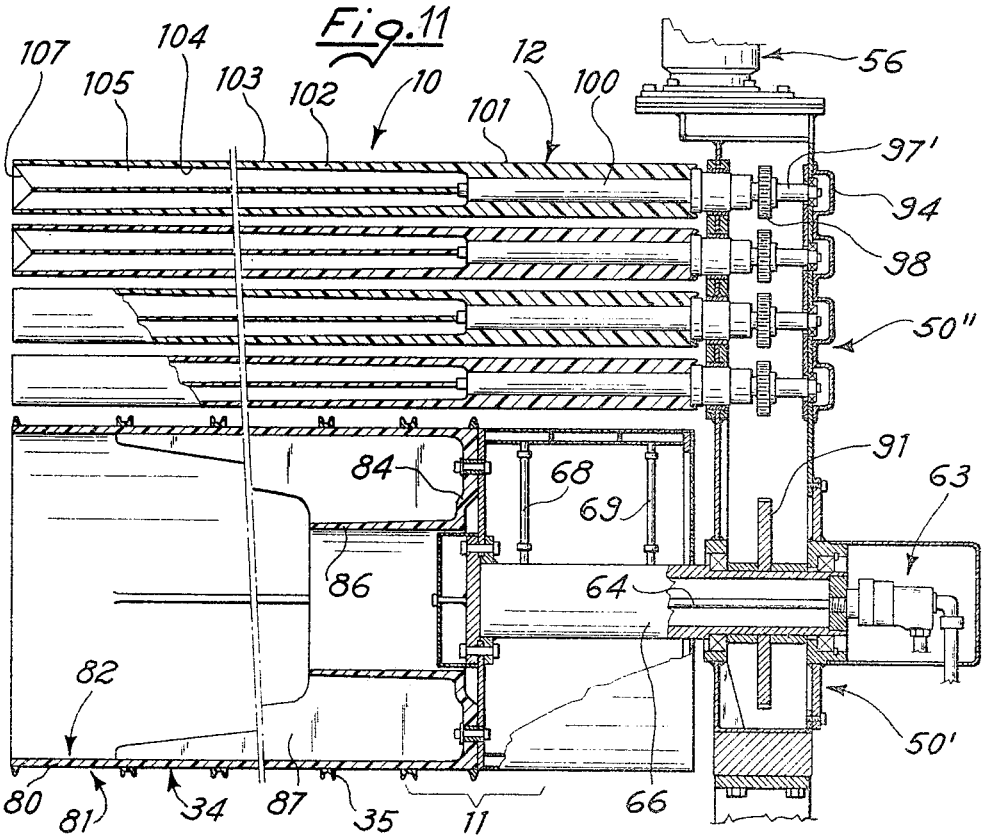

DEVICE FOR THE CONTINUOUS SPINNING OF VISCOSE RAYON

BACKGROUND OF THE INVENTION (a) The Field of the Invention

The present invention refers to a device for the continuous spinning of viscose rayon. More specifically it refers to a machine of the type which comprises a main treatment or processing roller, on which are carried out the chemical and thermal treatments to which the yarn must be subjected, and a plurality of secondary or advancing rollers, having axes askew with respect with the main roller. A plurality of yarns may advance and be processed concurrently on such a device of this kind, all of them passing over the main roller while each one of them passes over its own advancing roller.

(b) The Prior Art

A number of spinning machines of the general type described have been disclosed in previous patents, e.g. in Italian Pat. Nos. 516,501 and 535,752, but none of them is fully satsifactory for industrial production, particularly with respect to their sturdiness, construction costs, accessibility for maintenance, ease and reliability of operation, etc. Further, they do not furnish absolutely uniform yarns, because the paths of the several yarns treated on the same spinning machine but on different advancing rollers, are different, and therefore the yarns are processed somewhat differently and, since they are extremely sensitive even to small processing differences, have different characteristics. This drawback appeared to be an inevitable consequence of the very concept of a spinning machine having a plurality of advancing rollers.

SUMMARY OF THE INVENTION

The continuous spinning device for viscose rayon which forms the object of the present invention, on the contrary, suprisingly eliminates this drawback and produces absolutely uniform yarns, and it possesses to an optimal degree all the characteristics desirable in devices of this kind, thanks to a new and original structure which embodies in a novel and different manner the principle of the spinning machine having a main processing roller and a plurality of askew treatment rollers.

In particular the invention provides a novel structure and mutual arrangement, as well as novel structural and functional connections of the several parts constituting a spinning unit, viz. the main or treatment roller, the secondary or advancing rollers, the means for their support and assemblage, etc., as well as the association of a plurality of spinning units to constitute a spinning machine.

Specifically, the spinning unit according to the invention is characterized in that the processing roller and the advancing roller are carried bracket like by a support arm in which they are rotatively supported; that the actuating structures are located in the vicinity of the supports of the rollers; that the support arm is hollow and contains the roller supports and the actuating structures; and that the support arm is located at the end of the unit at which the yarns leave the same after being processed.

BRIEF DESCRIPTION OF THE DRAWINGS

Other characteristics of the spinning unit and machine which are the object of the invention will clearly appear from the following description, with reference to the attached drawings wherein:

FIGS. 10 and 11 are views analogous to FIGS. 2 and 4, respectively, but illustrating a different embodiment of the invention.

DETAILED DESCRIPTION OF THE INVENTION

Figure 1:
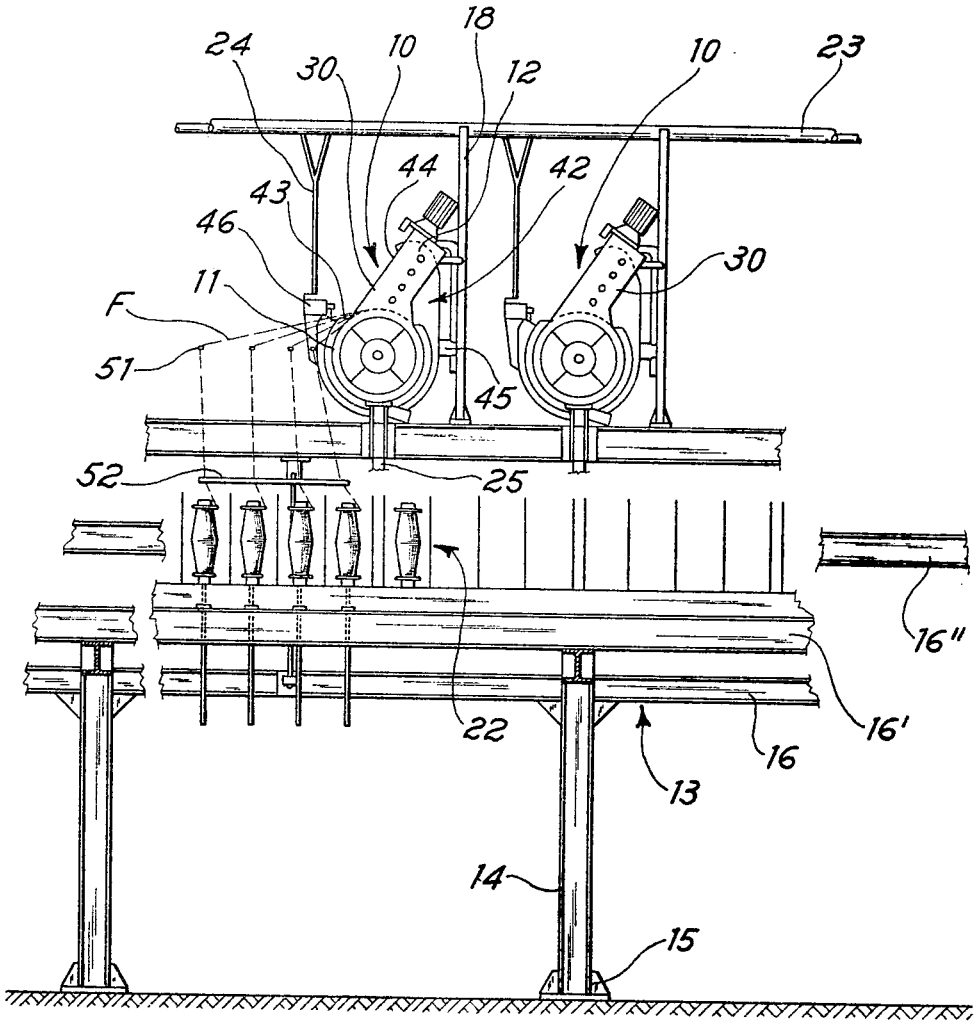
FIG. 1 is a partial overall view of a spinning device according to an embodiment of the invention, in a vertical plane perpendicular to the axes of the treatment rollers of the several units which make up the spinning machine (two of which are shown, but which could be three or more)
Figure 2:
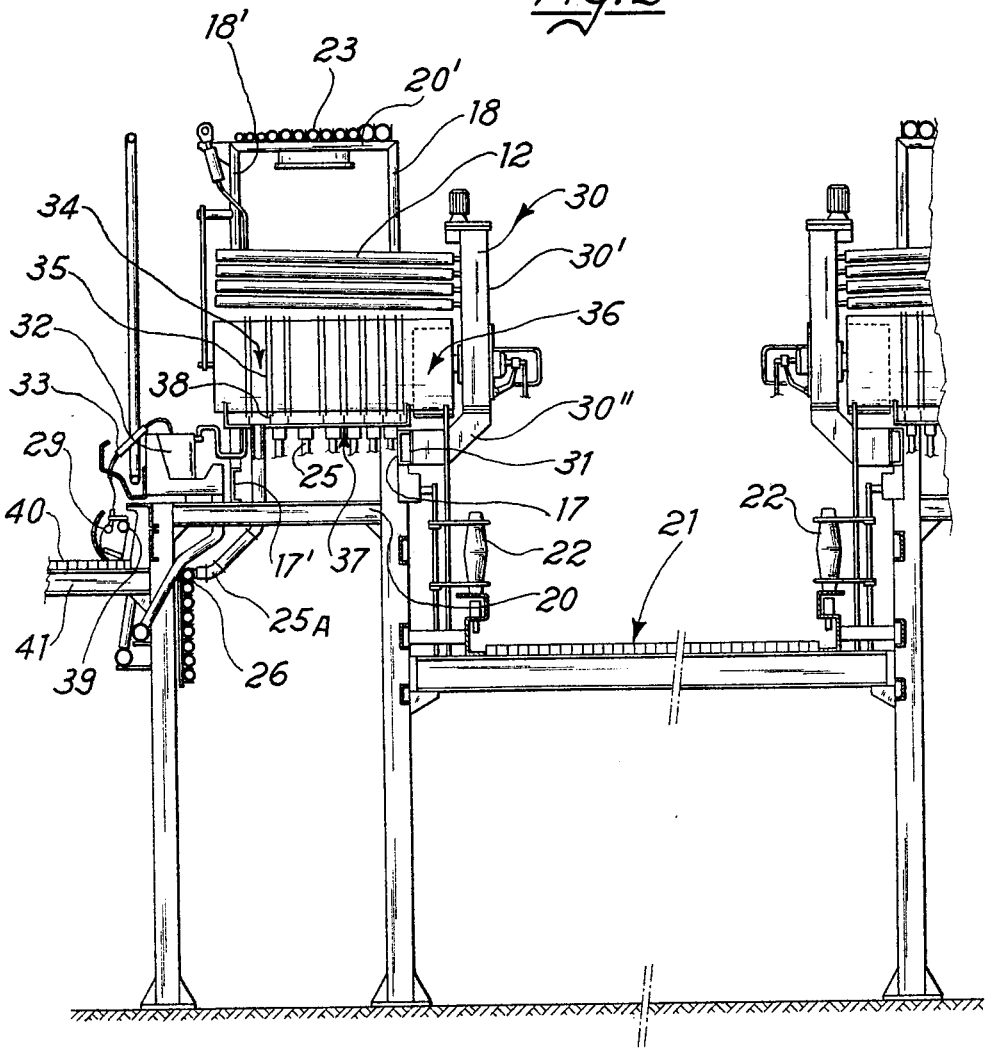
FIG. 2 is an elevation and partial section of the device of FIG. 1, on a vertical plane perpendicular to that of FIG. 1.

With reference to FIGS. 1 and 2, an industrial spinning machine according to the invention is first of all composed of a variable number of spinning units, each of them generally indicated by numeral 10 and each composed of treatment or processing roller 11 and several advancing rollers 12. These latter have been shown in the number of four because this number is often used in practice, but a larger or smaller number thereof might be adopted, as known in the prior art. A number of spinning units is disposed side by side, as seen in FIG. 1 to constitute a row of units and each of the units is separately supported on a general frame, generally indicated at 13. This latter, in the embodiment illustrated, preferably comprises main uprights 14 fixed to the ground at 15, lower beams 16, 16', 16'', upper beams 17, 17', secondary uprights 18, 18' fixed at 19 to the upper beams 17, 17' respectively, and lower cross-ties 20 and upper cross-ties 20' respectively connected to the main and the secondary uprights.

Of course the structure of the frame may be varied in any desired way, as long as it furnishes the required support to the spinning units, the twister groups, and the manifolds and accessories that will be described, and permits the operators to reach whatever parts they must reach to operate and maintain the machine.

Preferably the spinning machine comprises two specularly opposed rows, the direction of each row being perpendicular to the axes of the units, as is seen in FIG. 1, wherein two spinning units are shown, and in FIG. 2 in which one unit of one row is illustrated entirely and one of the other row is illustrated framentarily, The preferential disposition of the units in two opposed rows permits them to be served from a single floor 21 (FIG. 2) supported by cross-ties placed at a suitable height. Over such floor the twister groups are mounted, which are known per se and therefore are not shown nor described, only the cops 22 being schematically illustrated in the figures, such cops being, of course, as many as the advancing rollers, in this embodiment four for each unit. The cops of one spinning group and one of the cops of the other spinning group are shown in FIG. 1, the remaining cops being omitted to simplify the illustration. The figures also show the general feed manifolds 23 which feed the baths or treatment liquors to all the spinning units of each row and from which branch out, for each unit, pipes 24 carrying the several liquors to the appropriate points of each unit; as well as the liquor discharge pipes 25 of which only the initial portion, immediately below the spinning units, is shown in the figures.

In FIG. 2 one of such pipes—25A—is shown, initially in cross-section, in its entire length all the way to the general discharge manifold 26 wherein are collected together all the discharges of a given type of liquor from one spinning unit.

Figure 3:
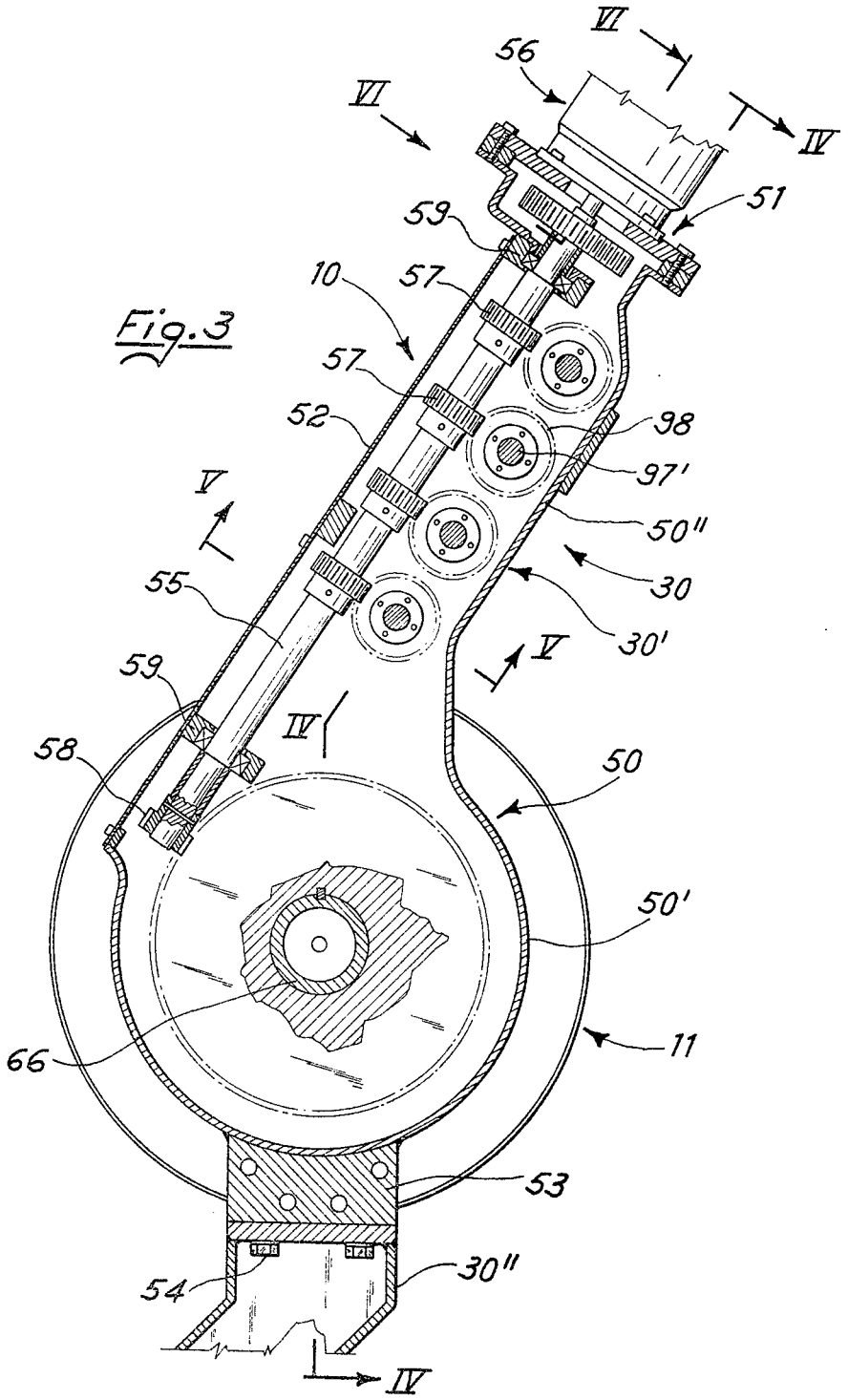
FIG. 3 is a cross-section taken on the plane III—III of FIG. 4, at an enlarged scale, showing the bearing structure and the actuating means of the cooperating treatment and advancing rollers of one of the units of FIG. 1.

Each spinning unit is supported by a support arm generally indicated at 30, which contains the supports and the actuating mechanism of the various rollers, to be more particularly described hereinafter. The arm is bracket-shaped, is suitably divided into several portions according to constructive conveniences, e.g. in two portions 30′ and 30″ as seen in FIGS. 2 and 3, and is fixed at 31, by means of bolts or other suitable means, to an upper beam 17. The whole unit is supported bracket-like on such single support element, and this is an important characteristic of the invention which provides considerable constructional and operative advantages.

The travel of the yarn is from left to right as shown in FIG. 2, for the row of units completely illustrated (on the left), and of course in the opposite direction for the partially illustrated specularly opposed row (on the right). The viscous solution feed means may be of any kind, but FIG. 2 shows by way of example a group of pumps generally indicated at 29, a viscose feed pipe 39 and a coagulating trough 32, to which the viscose solution is conveyed by the general manifold 33. From through 32 the several yarns are guided, by means not shown, to the respective spinning units. Each of the processing rollers is divided in a known way, into a number of liquid treatments zones generally designated by numeral 34 and separated by flanges 35 and which may be collectively called "the treatment drum", and a driving zone 36. The treatment liquors, after contacting the yarns, drip into a liquor collecting tub 37 divided into as many compartments as are the liquid treatment zones 34, each compartment being provided with a discharge pipe 25, suitable partitions 38 being provided to separate the several compartments from each other. A floor 40 supported by cross-ties 41 (FIG. 2) supports the pump groups and the other viscose feed means and permits the maintenance. thereof.

Other pipes and services, e.g. for conveying water, compressed air, etc., may be provided as desired, in general according to the known state of the art, and need no description.

Each spinning unit is provided with a protective hood 42 (FIG. 1), which is preferably one piece with the liquor collecting tub 37 and is an extension thereof, as seen in FIG. 1. However the hood could, if desired, be separate from the tub. In any case it envelops a major portion of the periphery of the treatment rollers and then continues upwards, as seen in FIG. 1, curving about the uppermost advancing roller, whereby to provide a protection for the entire spinning unit, except for a gap between its lower edge 43 and its upper edge 44. Thus it does not completely enclose the spinning unit, but since suitable suction manifolds are provided, the initial portion whereof is indicated at 45 in FIG. 1, air is drawn from the room and the escape of harmful vapours from the yarn treatment zone into the room is not permitted. Other suction means are of course provided in a known manner for drawing off the vapour which evolves in the yarn drying zone.

The troughs 46 into which the liquors are conveyed by pipes 24, and from which they are conveyed, in a known manner, onto the processing roller are also seen in FIG. 1, and parts of the several yarns F are illustrated therein, which yarns leave the treatment roller at different tangential positions and pass onto yarn guides 51 and then are guided to the cops 22 by guide means known per se, generally indicated at 52.

FIGS. 3, 4, 5 and 8, particularly illustrate the structure of a spinning unit 10. The support arm 30 is particularly illustrated in FIG. 3. It comprises a first part 50 which comprises a cylindrical portion 50′ and a portion 50″ which extends along the ends of the advancing rollers, an upper head generally indicated at 51, and a plate 52 which is removable to permit the inner mechanisms to be maintained. The described elements constitute the part 30′ of the arm, which is connected, e.g. by means of a bracket 53 welded to the portion 50′, to the part 30″ connected to the frame in any suitable way, e.g. by bolting as indicated at 54.

Figure 6:
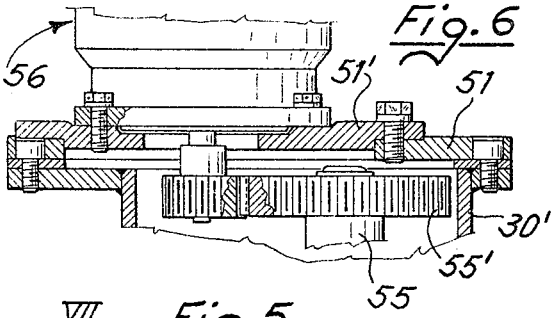
FIG. 6 is a detail, seen on the plane indicated by VI—VI in FIG. 3, of the actuating mechanism of any one of the advancing rollers.

An actuating shaft 55 extends within the upper part of arm 30 and precisely the part 30′ thereof (see FIG. 6 for the details), which shaft is actuated through a pair of gears 55′ by a motor generally indicated at 56, carried by plate 51 and flange 51′ and which may be of any convenient structure. Gears 57 for actuating the advancing rollers and 58 for actuating the treatment roller are keyed onto shaft 55. The shaft supports are indicated at 59.

Figure 9:
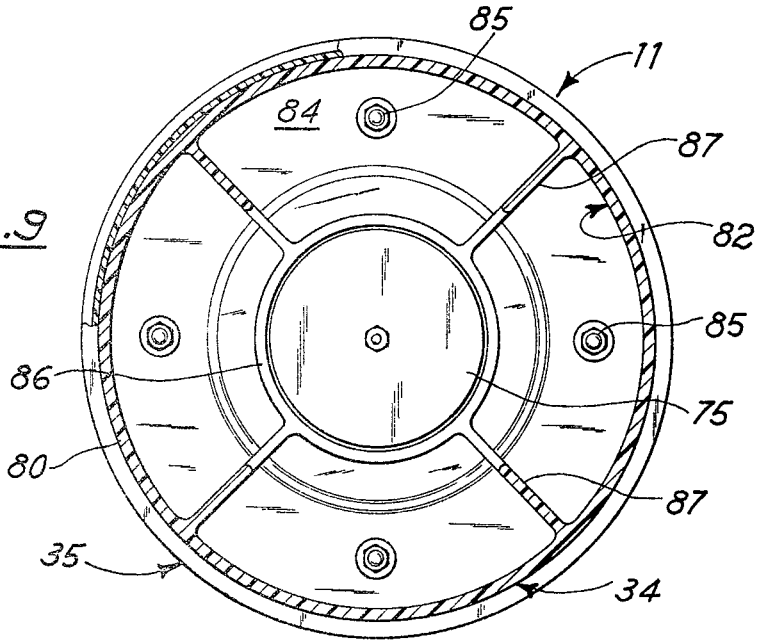
FIG. 9 is a transverse cross-section, on the plane and in the direction indicated at IX—IX in FIG. 8, of the processing roller.

The treatment roller (see the details in FIGS. 8 and 9) comprises, first of all, a metal portion which may be called "the drying drum", indicated at 60. Such portion is provided with a jacket 61 for the circulation of a heating fluid, e.g. hot water, provided with partition 62 to determine a helical path of the heating fluid. This latter is fed and discharged by means of a group generally indicated at 63 (FIG. 4) which feeds it first of all to a pipe 64 opening into a chamber 65 within a hollow shaft 66 and separated from the remaining cavity of the shaft by a partition 67. The heating fluid passes from chamber 65 through a pipe 68 to the double jacket 61 from which it then returns through a pipe 69 to the cavity 70 of the hollow shaft, which is located on the other side of the partition 67, and flows out of the shaft through group 63.

The drying drum 60 is mounted on shaft 66 in any convenient way, preferably as follows. A plate 71 is welded or fixed in any way to the end of the shaft 66. Bolts 72 lock, between plate 71 and a counterplate 73, an annular plate 74 which constitutes one of the head plates of the drum 60. The counterplate 73 is also preferably connected to a centering sleeve 75 and centering pins 76, these latter registering with partition 67, while sleeve 75 is engaged by the remaining part of the treatment roller, viz. by the "liquid treatment drum". The liquid treatment drum is preferably made of a resin, as is more fully discussed hereinafter. It comprises an outer part provided with a cylindrical surface 81 and with an inner surface 82 which is preferably slightly frusto-conical, so that the thickness of the drum wall 80 decreases slightly from the end adjacent the drying drum to its free end. The liquid treatment drum is not completely illustrated in FIGS. 4 to 8 for reasons of space and is interrupted, so that the liquid treatment zones 34, which in this embodiment as illustrated in FIG. 2 are eight, are not all visible. Correspondingly only some separation flanges 35 are visible. Such flanges are double except the first and the last ones which are single, as is seen in the figure, and are conveniently constituted by rings of rubber or of another elastic material slipped onto the drum wall 80. The liquid treatment drum is fixed to the drying drum 60 through a head 84 and bolts 85 which connect head 84 to the head plate 74 of the drying drum. In the embodiment illustrated, the liquid treatment drum is provided with an inner stiffening sleeve 86, which with its cylindrical inner surface engages the sleeve 75 and is provided with a tapering outer surface, so that its thickness decreases from the end adjacent head 84 to the opposite end. Sleeve 86 is preferably connected to drum wall 80 by radial fins 87 having a decreasing height, as seen in the figure.

The treatment roller assembly is supported in arm 30 by means of shaft 66 through ball bearings 90, 90' (FIG. 8), and carries in a position intermediate such bearings, a toothed wheel 91 which engages gear 58, spacers 92–92' being interposed between wheel 91 and the aforesaid bearings.

Figure 7:
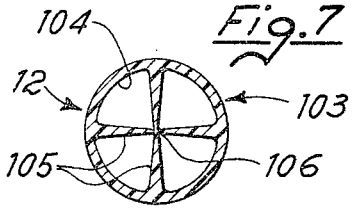
FIG. 7 is a transverse cross-section taken on plane VII—VII of FIG. 5, of any one of the advancing rollers, showing a non-metallic portion thereof.

Advancing rollers 12 are set with their axes askew with respect with the treatment roller, the slant being conveniently calculated to cause the yarns to travel in the desired helical paths. The askew disposition of the rollers is not visible in the figures, since the angles are anyway very small, and, to facilitate the illustration, it has been assumed that the axes of the advancing rollers may be considered as lying on the same plane. Each advancing roller is provided with a shaft 97 supported in arm 30 by means of two supports. The details of the advancing rollers are shown in FIGS. 4, 5 and 7.

Their outer support comprises a ball bearing 93 protected by a box 94, while the inner support comprises a roller bearing 95, the inner rolling track whereof is formed (to conform to the dimensional conditions of the invention) by the surface of the portion 96 of the roller support shaft 97. Such shaft comprises a smaller diameter part 97', onto which toothed wheel 98, which meshes with actuating gear 57, is keyed.

Figure 4:
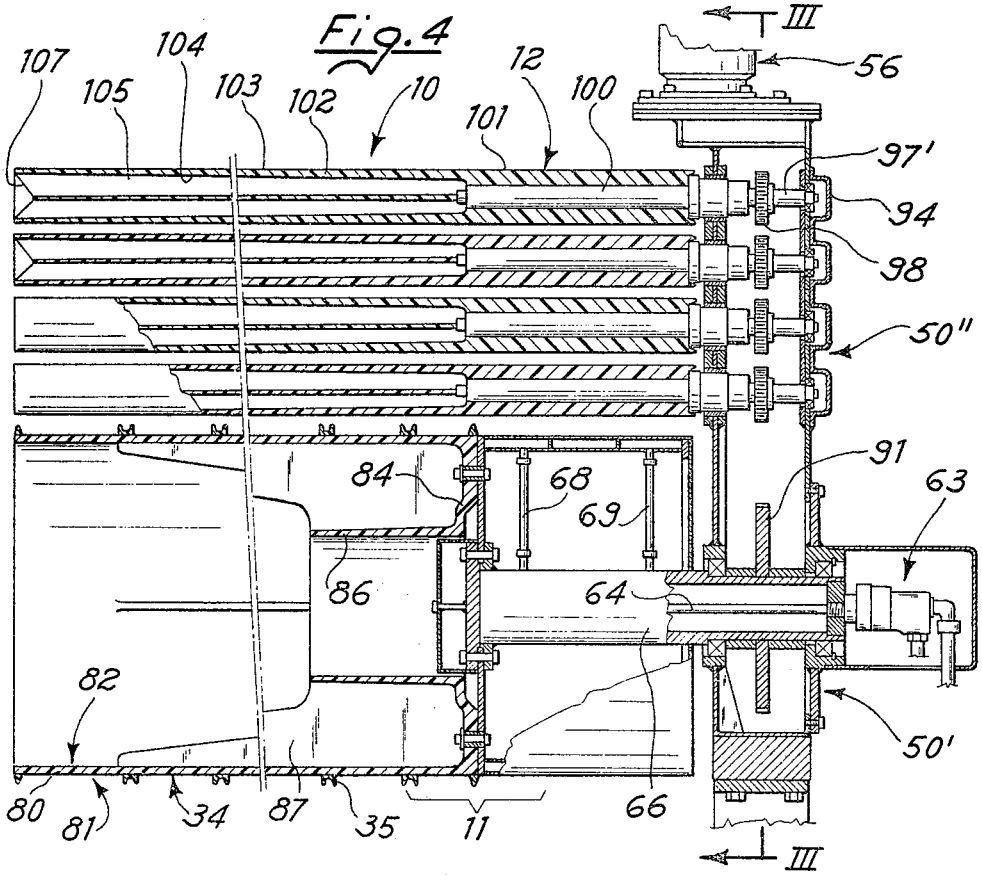
FIG. 4 is a cross-section of the device of FIG. 1 taken on the planes IV—IV—IV of FIG. 3, passing through the axes of the advancing and treatment rollers.
Figure 5:
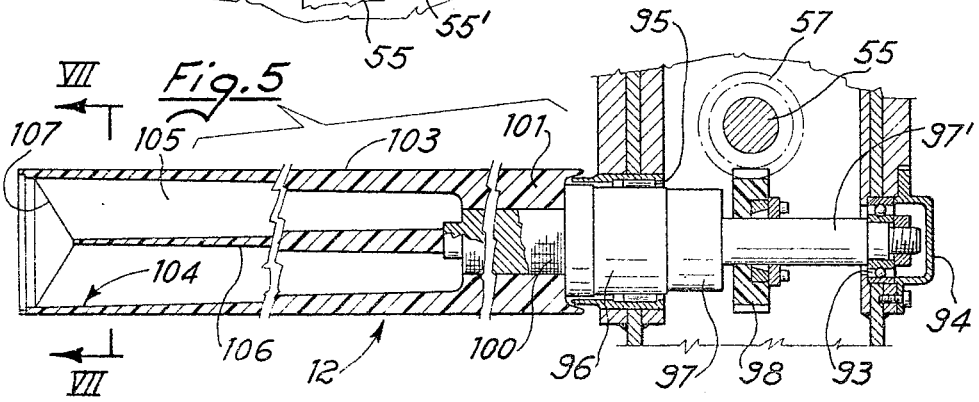
FIG. 5 represents, in cross-section on the plane indicated by V—V in FIG. 3, but at an enlarged scale and fragmentarily (in order to evidence characteristics of the elements) the structure and the support and actuating means of an advancing roller (which may be taken to be any one of them)
Figure 8:
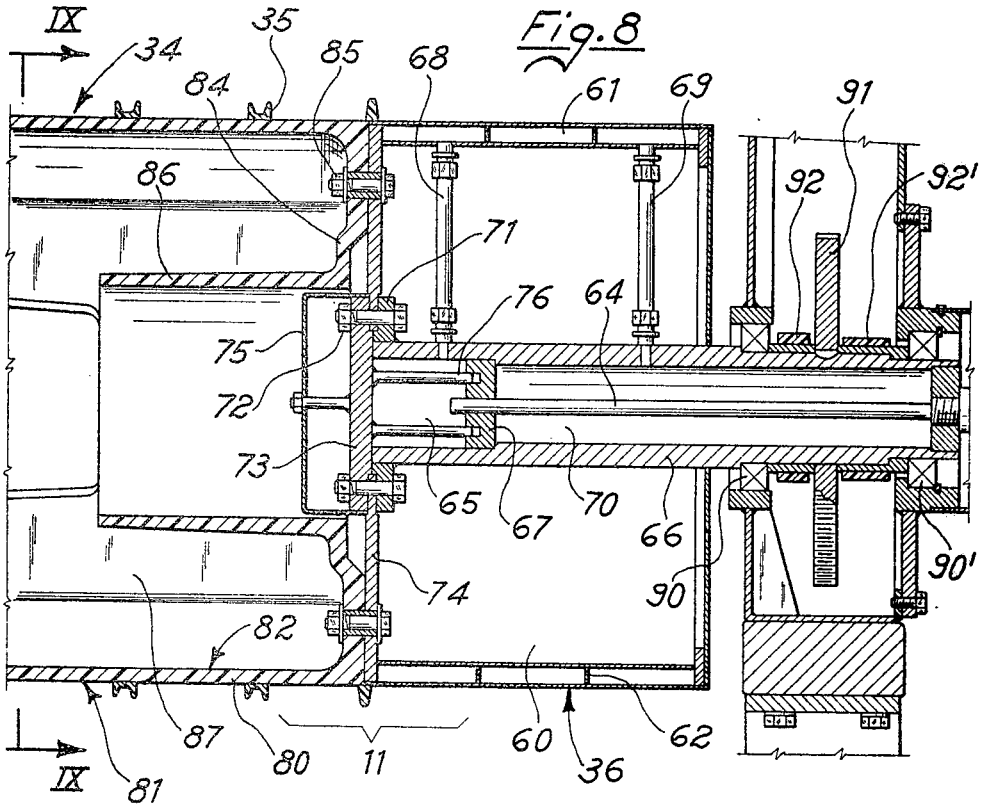
FIG. 8 represents, fragmentarily, at an enlarged scale, in a greater detail and on the same plane IV—IV of FIG. 3, the support structure and the actuating means of a processing roller.

Shaft 97, which is an integral part of the advancing roller, is made up of different segments having different diameters, as is seen in FIGS. 4 and 5. A smaller diameter segment 100, which constitutes a component of the roller proper, is connected to the central segment 96. The roller is completed by a resin portion 101, which is cast or moulded on the metal segment 100 in such a way as to become inseparable therefrom. Preferably, to this end, the surface of the cylindrical part 100 is roughened or knurled or anyway rendered irregular to facilitate the adhesion of the resin, which thereafter becomes locked onto part 100 also as a consequence of its shrinkage during cooling after moulding. Metal segment 100, however, occupies only a relatively small portion of the active length (viz. the length on which the yarn is wound) of the advancing roller, e.g. between 1/10 and 1/6, the remaining portion being hollow and constituted only by resin. This portion, indicated at 102, has an outer wall with a cylindrical outer surface 103 and an outwardly tapered frusto-conical inner surface 104, whereby the thickness of portion 102 decreases from the zone adjacent the metal segments 100 to its end. Preferably the roller portion is provided with fins 105 arranged more or less like a cross (FIG. 7), which mutually connect at a common central part 106 and preferably end with surfaces 107 slanted towards the free end of the roller, as seen in FIGS. 4 and 5.

The resin used for the treatment roller should possess certain critical characteristics. First of all it should have a high Shore hardness, at least 80 and preferably not less than 90. Resins which meet this requirement are, e.g. epoxy resins such as araldite or certain reinforced resins, e.g. polyamides or polyesters reinforced with glass or other mineral fibres. Further the resins should hve a tensional strength not less than 720 $Kg/cm^2$ and bending strength not less than 1200 $Kg/cm^2$ as well as an elasticity modulus under tension not less than 130,000 $Kg/cm^2$. Further they should be chemically resistant to the liquors employed for the treatment of viscose yarn and should not absorb water. As has been said, araldite and like epoxy resins are satisfactory, and other resins may be rendered satisfactory by suitable mineral charges.

The same resin is conveniently used for the advancing roller. In general the elastic characteristics of the resin employed for the advancing roller should be such that the maximum sag of the rollers due to bending under their own weight should not be greater than two, preferably one tenths of a millimeter. The sag naturally depends both on the characteristics of the resin and on the geometry of the advancing rollers. If these latter are thicker, they are stronger but also heavier. Consequently the desired low sags cannot be obtained if the characteristics of the resin are not adequate.

In the spinning machine according to the invention it is highly desirable that the advancing rollers not be too far apart from each other, both to limit the space taken up, and to create optimum angles of the trajectories of the yarns at the points where they leave the treatment roller, whereby to minimize on the one hand the free paths of the yarns, and on the other suitably to differentiate their angular orientations.

Preferably the distance between the axes of two adjacent advancing rollers should not be greater than 1.5 and still more preferably not greater than 1.25, times the outer diameter of the advancing rollers. The distance between the outer surfaces of the treatment roller and of the advancing roller closest thereto is slightly greater than the distance between the outer surfaces of adjacent advancing rollers, and e.g. may be 1.5–2 times this latter distance.

Another embodiment of the invention is illustrated in FIGS. 10 and 11 which are analogous to FIGS. 2 and 4. A spinning machine according to this embodiment is adapted for the production of viscose rayon yarns by processes requiring only a small number of liquid treatments, possibly only one or two of them. Correspondingly there will be a small number of treatment zones and of separation flanges or other separation means on the processing roller and a small number of partitions in the liquor collecting tub, as well as fewer means for conveying the treatment liquors to the processing roller.

The spinning machine illustrated in FIGS. 10 and 11 differs from that illustrated in the preceding figures only because of a reduction in the number of liquid treatments and treatment zones of the processing roller and of the other means associated therewith. The parts which are unchanged with respect to the embodiment of FIGS. 1 to 9 are indicated by the same numerals, as clearly seen by a comparison with FIGS. 2 and 4, and their description will not be repeated. However the processing roller now comprises only two treatment zones 34, and correspondingly only one flange 35, as well as a drying zone or drying drum 36. Only two liquid treatments are carried out, e.g. an acid treatment and a washing treatment. There are still four advancing rollers 12.

Both the treatment roller and the advancing rollers may be shorter than required when the liquid treatments are more numerous. One flange 38 is provided for defining two compartments in the liquor collecting tub 37.

The invention has been illustrated by the description of preferred embodiments, but it may be carried out with many variations, modifications and adaptations by persons skilled in the art.

We claim:

1. A spinning unit for the continuous spinning of viscose rayon, said unit comprising, in association with viscose feeding and coagulating means, means for feeding and applying treatment and wash liquors, a collecting tub for the liquors, and means for discharging the collected liquors:

treatment means for simultaneously treating a plurality of viscose rayon yarns, said treatment means comprising a single treatment roller having axially spaced therealong plural separate treatment zones through which each of said yarns is sequentially passed;

a plurality of advancing rollers, each said advancing roller advancing a single respective said yarn only, said advancing rollers having askew longitudinal axes, each said advancing roller having a diameter substantially smaller than the diameter of said treatment roller, and said advancing rollers being spaced from said treatment roller by varying distances;

a hollow support arm having a pair of spaced walls;

each of said treatment roller and said advancing rollers having on a first end thereof a pair of supports respectively housed and supported in said pair of walls of said support arm;

each of said treatment roller and said advancing rollers having a second end which is free and unsupported; and means positioned between said pair of supports of each of said treatment roller and said advancing rollers for imparting driving movement thereto.

2. A unit as claimed in claim 1, wherein said driving means comprises, for each of said treatment roller and said advancing rollers, a gear fixed to the axis thereof at a position between said two supports thereof, and shaft and gear means for simultaneously rotating all of said gears and for thereby synchronously rotating said treatment roller and said advancing rollers.

3. A unit as claimed in claim 1, wherein said support arm is located at the end of said unit from which said yarns leave said unit after having undergone the desired treatments.

4. A unit as claimed in claim 1, wherein said treatment roller comprises a roller actuating shaft, a metal drying drum provided with heating means and keyed onto said roller actuating shaft, and a liquid treatment drum made of resin and fixed to an end of said drying drum, said liquid treatment drum having on an outer surface thereof means for mutually separating said plural separate treatment zones.

5. A unit as claimed in claim 4, wherein said drying drum and the liquid treatment drum are hollow.

6. A unit as claimed in claim 1, wherein each said advancing roller comprises an essentially cylindrical metal core which extends over a part of the active length of the same and which is covered with a synthetic resin portion, the remaining part of said advancing roller being hollow and constituted by an extension of said synthetic resin portion.

7. A unit as claimed in claim 6, wherein said hollow part of each said advancing roller is provided with a wall which becomes progressively thinner from said first end thereof toward said second end thereof.

8. A unit as claimed in claim 6, wherein the surface of said metal core of each said advancing roller is provided with irregularities, to thereby strengthen the bond of the resin thereto.

9. A unit as claimed in claim 6, wherein said metal core extends axially over a part from one tenth to one sixth of the active length of the respective said advancing roller.

10. A unit as claimed in claim 6, wherein each said advancing roller metal core extends towards said hollow support arm, beyond the active length of the respective said advancing roller, and has two support zones on which bearings comprising said pair of supports are engaged, the axially outer said support zone having a smaller diameter than the said support zone adjacent the active part of the respective said roller, and said driving means comprises an actuating gear keyed to said metal core intermediate said two support zones.

11. A unit as claimed in claim 1, wherein each of said treatment roller and said advancing rollers include portions formed of synthetic resins having a Shore hardness of at least 85.

12. A unit as claimed in claim 11, wherein said synthetic resins are selected from the group consisting of epoxy resins, polyamide resins reinforced with mineral fibers, and polyester resins reinforced with mineral fibres.

13. A unit as claimed in claim 1, wherein the distance between the axis of any two adjacent said advancing rollers is not greater than 1.5 times the outer diameter of said advancing rollers.

14. A unit as claimed in claim 1, wherein the distance between the outer surfaces of said treatment roller and of the said advancing roller closest thereto is 1.5–2 times the distance between the outer surfaces of adjacent said advancing rollers.

15. A unit as claimed in claim 1, further comprising a protective hood which extends about the major part of said treatment roller and of said advancing rollers, said hood being provided with suitable openings, and suction and discharge means for causing ambient air to be drawn into the space between said treatment and advancing rollers and about said rollers, and for thereby preventing the escape into the surrounding environment of gaseous substances evolved during the treatment.

16. A unit as claimed in claim 15, wherein said protective hood comprises a single member integral with said liquor collecting tub.

17. A unit as claimed in claim 4, wherein said drying drum is provided with a jacket, and further comprising means for conveying a heating fluid to said jacket.

18. A spinning machine for the continuous spinning of viscose rayon, said machine comprising a frame and a plurality of spinning units as claimed in claim 1, fixed to said frame.

19. A spinning machine as claimed in claim 18, wherein each said spinning unit is fixed to said frame by means of the respective said support arm which is rigidly connected at one of its ends to said frame.

20. A spinning machine as claimed in claim 18, comprising at least one row of said spinning units disposed parallel to one another and side by side in a direction perpendicular to the axes of said treatment rollers, and further comprising means for twisting and separately collecting each said yarn treated by each said spinning unit.

21. A spinning machine as claimed in claim 20, comprising two specularly opposed rows of said spinning units, with said hollow support arms of the units of one said row facing said hollow support arms of the units of the other said row, and further comprising means in said gaining access to said spinning units from both sides for purposes of control and maintenance.

* * * * *